US005413049A

United States Patent [19]

Feldmann et al.

[11] Patent Number: 5,413,049

[45] Date of Patent: May 9, 1995

[54] REDUCTION OF VELOCITY DECAY OF FIN STABILIZED SUBCALIBER PROJECTILES

[75] Inventors: Fritz K. Feldmann; Craig Christenson; Paul J. Griffith, all of Santa Barbara, Calif.

[73] Assignee: Pacific Armatechnica Corporation, Santa Barbara, Calif.

[21] Appl. No.: 91,226

[22] Filed: Jul. 13, 1993

[51] Int. Cl.[6] ..... F42B 14/06

[52] U.S. Cl. ..... 102/521; 102/703

[58] Field of Search ..... 102/520–523, 102/703

[56] References Cited

U.S. PATENT DOCUMENTS

| | | | |
|---|---|---|---|
| 3,695,181 | 10/1972 | Bull et al. | 102/520 |
| 4,187,783 | 2/1980 | Campoli et al. | 102/521 |
| 4,424,748 | 1/1984 | Schiff | 102/523 |
| 4,802,415 | 2/1989 | Clarke et al. | 102/434 |
| 4,815,682 | 3/1989 | Feldmann et al. | 102/521 |
| 4,833,995 | 5/1989 | Gotz et al. | 102/521 |
| 4,901,646 | 2/1990 | Feldmann et al. | 102/521 |
| 5,133,262 | 7/1992 | Schaake et al. | 102/521 |
| 5,138,949 | 8/1992 | Swartout et al. | 102/431 |

FOREIGN PATENT DOCUMENTS

| | | | |
|---|---|---|---|
| 183892 | 6/1986 | European Pat. Off. | 102/520 |

*Primary Examiner*—Harold J. Tudor
*Attorney, Agent, or Firm*—Patrick J. Walsh

[57] ABSTRACT

The terminal effectiveness of fin stabilized, subcaliber armor piercing projectiles depends primarily on the impact velocity at the target. The aerodynamic drag and related velocity decay experienced over the trajectory from the gun to target is reduced by shortening the length of the acceleration transfer interface between subcaliber projectile and discarding sabot. This applies for multiple annular grooves and helical grooves. Special groove configurations to reduce the pressure drag and related boundary layer shock wave interaction are disclosed. The reduction in length of the acceleration transmitting interface permits its location to a position aft of the point of boundary layer transition from laminar to turbulent flow and therewith to take advantage of the low frictional coefficient of the laminar boundary layer over a large portion of the subcaliber projectile. The resulting reduction in aerodynamic drag is particularly effective for mid caliber projectiles.

19 Claims, 3 Drawing Sheets

REDUCTION OF VELOCITY DECAY OF FIN STABILIZED SUBCALIBER PROJECTILES

BACKGROUND AND PRIOR ART

The present invention pertains to gun fired fin stabilized, discarding sabot projectiles. While proceeding along their trajectory from gun to target, such projectiles experience a reduction in velocity due to the action of aerodynamic drag. Since the terminal effectiveness of such kinetic energy armor piercing ammunition is in the first order a function of the impact velocity at the target, a reduction of the velocity decay during flight to the target is a powerful way to improve their performance, particularly at extended target ranges.

A typical fin stabilized armor piercing projectile with its discarding sabot, for example, is described in U.S. Pat. No. 4,901,646. Since the projectile is subcaliber, which implies that all its cross-sectional dimensions including the span of the fins, are less than the bore diameter of the gun barrel, the sabot is needed to support the projectile during travel in the barrel. Upon exit from the muzzle of the barrel the sabot is discarded automatically and the projectile is free to travel along its trajectory to the target.

A subcaliber fin stabilized long rod projectile is comprised of a cylindrical columnar main body, having an essentially conical nose configuration at front and a fin assembly for aerodynamic stabilization attached to its rear. To achieve the desired performance the projectile body preferably consists of a high density, high strength alloy such as tungsten heavy metal or depleted uranium. Characteristically, the fin assembly consists of four or more fins symmetrically arranged around the main body of the projectile. The subcaliber finned projectile is contained coaxially within the sabot and therefore travels along the axis of the gun barrel during launch. In addition to centering and radially supporting the subcaliber projectile, the sabot transmits the longitudinal acceleration caused by the gas pressure of the burning propellant to the subcaliber projectile. To facilitate this transmission a portion of the main body of the projectile is provided with a series of annular grooves which engage an equivalent mating section within the sabot. As an alternate the annular grooves may be substituted with a length of threads provided on the cylindrical body of the subcaliber projectile and engaging a mating thread on the interior of the aluminum sabot body.

In prior art the length of the grooved or threaded portion extends over a major portion of the cylindrical body of the subcaliber projectile varying in length from 4 to 10 times the diameter of said body, and some instances, over the entire length of the cylindrical body, i.e. from the fin assembly to the shoulder of the projectile nose. While the annular grooves or the threaded portion of the subcaliber projectile is adequate to transfer the launch acceleration from the discarding sabot, its configuration, particularly its length and location, induces adverse effects on the aerodynamic performance during flight to the target resulting in increased velocity decay and correspondingly lower impact velocities at the target. It is an object of this invention to reduce the adverse aerodynamic effects of the structural interface and resultant excessive velocity decay.

SUMMARY OF THE INVENTION

The aerodynamic drag of a fin stabilized subcaliber projectile consists of the drag of the projectile nose, the drag of its cylindrical main body including base drag, the drag of the fin assembly and last but not least a parasitic drag induced by either the annular grooves or the threaded section provided on the cylindrical body as required to transmit the launch acceleration from the sabot to the subcaliber projectile. The aerodynamic drag is composed of a pressure or wave drag depending on the aerodynamic configuration and a friction drag resulting from surface friction. It is known that the magnitude of the total drag is a function of the projectile velocity, the Mach number and the Reynolds number and that the latter has a pronounced effect on the nature of the boundary layer and the resulting surface friction.

Most fin stabilized (long rod) subcaliber projectiles fired from 20 to 35 mm cannons have a Mach number of approximately $M=4$ at launch and operate over a range of Reynolds numbers $Re \approx 10^6$ to $10^7$ where the Reynolds number is defined as follows:

$$Re = \frac{V \times L}{\nu}$$

where:

V=Projectile velocity (m/s)

L=Total Projectile Length (m)

v=kinematic viscosity of air ($m^2/s$)

The object of this invention concerns the reduction of the aerodynamic drag induced by the annular grooves and/or the threaded section applied to the cylindrical main body of the subcaliber projectile as necessary to transmit the launch acceleration from the aluminum component of the discarding sabot. Other components of the total projectile drag are only discussed as they influence the object of the invention. It is furthermore an object of the invention to define the length and the most effective configuration of the force-transmitting interface as well as its optimum location on the cylindrical main body.

To minimize the adverse effect on the aerodynamic drag the force-transmitting interface, consisting either of annular grooves or a threaded section, should be as short as possible. Since the subcaliber projectile body preferably consists of a high strength high density metal, such as tungsten alloy or depleted uranium alloy on the one hand and the mating aluminum alloy sabot having lower strength properties on the other, the minimum number of annular grooves and/or the length of the threaded portion is determined by the latter. Preferably the structural calculation should be based on the dynamic strength properties of the aluminum alloy. Limiting the number of annular grooves or the length of threads results in a reduction of the aerodynamic pressure or wave drag. This drag component is induced by the shock waves emanating from the surface discontinuities at the exterior of the cylindrical main body.

The most effective placement of the force-transmitting interface on the cylindrical body of the subcaliber projectile is a further object of the invention. As is known, the boundary layer along a conical-cylindrical body is laminar over its frontal portion provided of course, that the surface of the body is smooth and without irregularities such as steps or grooves to induce adverse pressure gradients. At a certain distance downstream from the projectile tip the laminar boundary layer becomes instable and transition to turbulent condition occurs. The critical Reynolds number at which transition occurs is in the first order a function of Mach number, M. The projectile under consideration has a value of approximately $Re_{Tran} \approx 5 \times 10^6$ based on distance measured from the projectile tip at a Mach number from between 4.2 and 3.5. In the case of a subcaliber fin stabilized projectile having a length of 140 mm, the transition occurs at 55 to 60 millimeters from the tip, i.e. approximately halfway between the projectile tip and the front of the fin assembly. Placement of the force-transmitting interface, i.e. its annular grooves or a section of threads aft of the station where boundary layer transition occurs, provides the advantage of making optimum use of the low boundary layer friction coefficient characteristic of laminar boundary layer. As is well known, the friction coefficient of the turbulent boundary layer encountered downstream of the transition is considerably higher. If the structural interface on the cylindrical body of the subcaliber projectile is stationed ahead, i.e. upstream, of the point of natural boundary layer transition, forced transition will occur at that point including the correspondingly higher friction coefficient as is the case in the current state of the art. Such forced transition is also accompanied by a more rapid growth of the boundary layer and may lead to separation of the boundary layer. The advantages of the invention are evident in a reduction of the velocity decay as determined by radar measurement to a range of 2000 meters and have been substantiated qualitatively by schlierenphotography of projectiles in flight. In summary, the invention reduces the decay of the projectile velocity in its flight to the target by minimizing the length of the structural interface consisting of either annular grooves or a threaded portion and its location on the cylindrical main body of the subcaliber projectile. The invention is equally applicable to spinning and non-spinning fin stabilized projectiles.

BRIEF DESCRIPTION OF THE DRAWINGS

The objects and advantages of the invention will become apparent from a consideration of the drawings and ensuing detailed description.

DETAILED DESCRIPTION OF THE EMBODIMENTS

Figure 1:
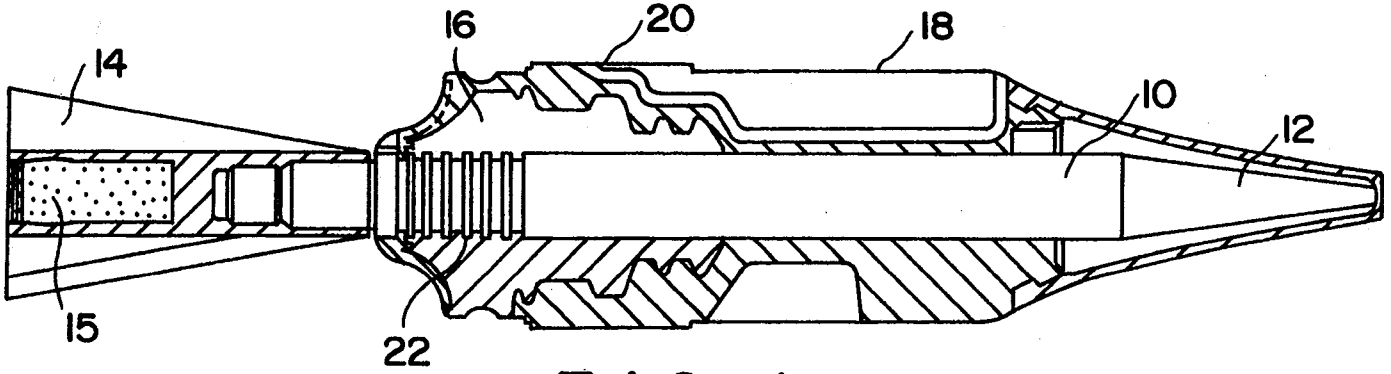
FIG. 1—is a longitudinal cross-section of a fin stabilized subcaliber projectile discarding sabot assembly.

A longitudinal cross-section of the tin stabilized subcaliber projectile sabot assembly is presented in FIG. 1. The subcaliber projectile comprises the cylindrical body 10, the conical nose 12, the cruciform fin assembly 14 attached at the rear. The cylindrical body 10 and the projectile nose 12 preferably consist of a high density, high strength metal such as a sintered tungsten alloy or a depleted uranium alloy. The fin assembly consists of a lower density metal such as aluminum or steel. In the case of a high velocity projectile aluminum fins require a protective coating for protection from the effects of aerodynamic heating. The fin assembly 14 commonly includes a pyrotechnic tracer 15.

The fin stabilized subcaliber projectile is contained in the discarding sabot as illustrated in FIG. 1. The particular sabot chosen for this illustration is designed for full spin hunch as described in U.S. Pat. Nos. 4,815,682 and 4,901,646. The main components of the discarding sabot are a three element aluminum base 16 contained coaxially in an injection molded plastic body 18 which serves as the bourrelet and at its rear is provided with a rotating band 20. Among others, the discarding sabot is needed to support the fin stabilized subcaliber projectile in a coaxial position within the barrel of the gun. The sabot is also required to transmit the launch acceleration to the subcaliber projectile. This is accomplished by the annular grooves 22 provided on the cylindrical body 10 and which engage a mating number of grooves within the aluminum base 16 of the sabot. In order to reduce the aerodynamic interference of the grooves during flight of the subcaliber projectile to the target, it is desirable to reduce the number of grooves as well as the space over which they are distributed to a minimum which is an embodiment of this invention. Since the strength properties of the aluminum sabot base are less than those of high density, high strength material of the subcaliber projectile the number of annular grooves is determined by the sabot base material. Therefore, it is preferable to use the dynamic strength properties of a high strength aluminum alloy such as 7075-T6 for the structural calculation. As an example for the subcaliber projectile having a length to diameter ratio of 12.5 for instance, the length over which six annular grooves are evenly spaced on the cylindrical body is not more than 1.4 body diameters.

Figure 2:
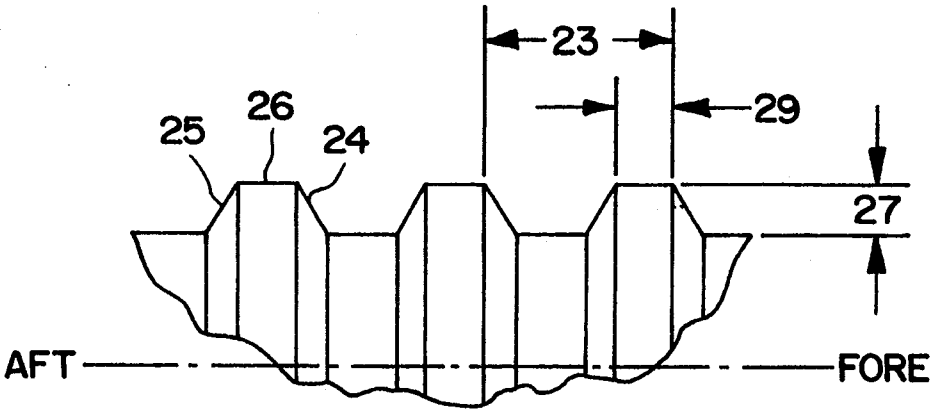
FIG. 2—presents a detailed view of the annular grooves.

A preferable configuration for the annular grooves is shown in FIG. 2. This groove profile is desirable frown aerodynamic considerations since it reduces the wave and pressure drag. The form of the groove has the following characteristics:

a. A load flank 24 angle of approximately thirty degrees measured from the normal to the axis.
b. A release flank 25 angle of at least thirty degrees measured from the normal to the axis.
c. A truncation at the crests 26 such that the depth of the groove 27 and the crest width 29 is approximately 0.3 times the groove spacing 23.

A load flank 24 angle of approximately thirty degrees is beneficial in that it permits shortening the length of the acceleration transmission interface, an embodiment of the invention, by redistributing a portion of the thrust into a radial component. The radial component of the thrust is directly offset by the gas pressure impinging on the periphery of the aluminum sabot base aft of the rotating band.

The release flank 25 angle should be thirty degrees or greater to reduce the magnitude of the adverse pressure gradient that occurs at this location in an attempt to prevent boundary layer separation and the concomitant increase in drag.

The crest width 29 should be maximized within the constraints allowed by the strength properties of the aluminum sabot so as to provide the best conditions for the re-attachment of separated flow that occurs due to the presence of grooves. For the same reason, the groove depth 27 should be minimized, preferably no deeper than 0.065 times the projectile diameter.

It should be mentioned that providing a total included angle between the load flank and release flank of sixty degrees or greater and minimizing the groove depth has a beneficial effect on sabot separation and subsequently, projectile dispersion.

Figure 3:
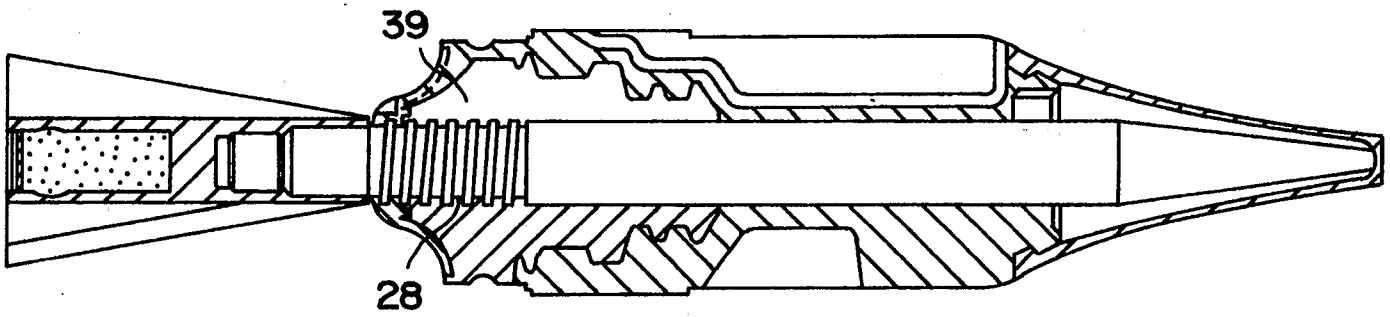
FIG. 3—is a longitudinal cross-sectional view of a fin stabilized subcaliber projectile discarding sabot assembly provided with a threaded section.
Figure 4:
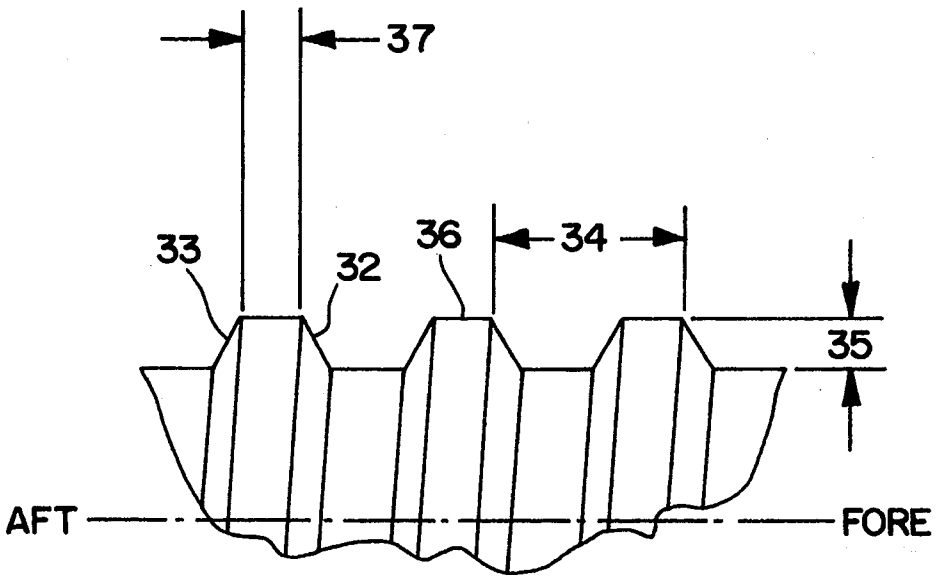
FIG. 4—presents a detailed view of the threaded section.

An alternate method to transfer the launch acceleration from the aluminum sabot to the subcaliber projectile is by means of a threaded section as illustrated is FIG. 3. Such a configuration is desirable in combination with a discarding sabot containing a screw-on type aluminum sabot base. Similar design considerations for the threaded section 28 apply as were discussed for the annular groove interface. The threaded section should be as short as possible and consist of a minimum number of threads. Preferably, the length of the threaded section should be based on the dynamic strength properties of a high strength aluminum to be used for the sabot base 30. To arrive at a low number of threads as desired to reduce the aerodynamic pressure and wave drag, the use of a high pitch is desirable. The thread pitch should be maximized within the constraints imposed by the strength properties of the material used for the mating sabot base. Based on the design consideration described above, a total thread length of approximately 1.5 diameters of the cylindrical projectile body was required. This applies for a high density metal subcaliber projectile having an approximate density of 18 g/cm$^3$ and a length to diameter ratio between 12–13. A stub acme thread or still better a modified 60° STUB thread profile as shown in FIG. 4 is used having a load flank 32 and a release flank 33 of thirty degrees and a pitch 34 of approximately 0.22 projectile diameters. The 60° stub thread profile shown in FIG. 4 has been modified from the standard form by truncating the thread crest 36 minimizing the thread depth 35 and increasing the crest width 37. The aerodynamic interference from the use of the threaded configuration described above is considerably less than that experienced with a standard metric thread configuration, for instance as used in a variety of current art applications.

A further embodiment of this invention is the location of the acceleration transfer interface, whether grooved or threaded, on the cylindrical main body of the subcaliber fin stabilized projectile. Projectiles of this type, also referred to as long rod projectiles, employed from automatic cannons having calibers ranging from 20 to 40 millimeters commonly are launched at muzzle velocities in the range of 1400 to 1450 meters per second. Because of their velocity and subcaliber projectile dimensions, the Reynolds numbers encountered over the trajectory from gun to target are such that the low friction coefficient of laminar boundary layer can be exploited successfully over a considerable portion of the projectile body by sound aerodynamic design. The resultant decrease in total aerodynamic drag will reduce the velocity decay from gun to target and permit higher impact velocities at the target which are important for armor penetration.

Over the main body of the subcaliber projectiles, which consists essentially of a slender conical nose and a cylindrical afterbody, a laminar boundary layer will form provided that the exterior surface is smooth and free of steps and other discontinuities. Preferably a surface roughness of 0.8 micrometers or less is desirable. At a station on the cylindrical portion of the subcaliber projectile a critical Reynolds number $Re_{Trans}$ is attained where natural transition of the laminar boundary layer to a turbulent boundary layer will take place. The critical Reynolds number is defined as follows:

$$Re_{Trans} = \frac{V \times L_{Trans}}{\nu}$$

where:

V = Projectile velocity (m/s)

$L_{Trans}$ = distance from the projectile nose to where natural transition occurs (m)

v = kinematic viscosity of air (m$^2$/s)

Figure 5:
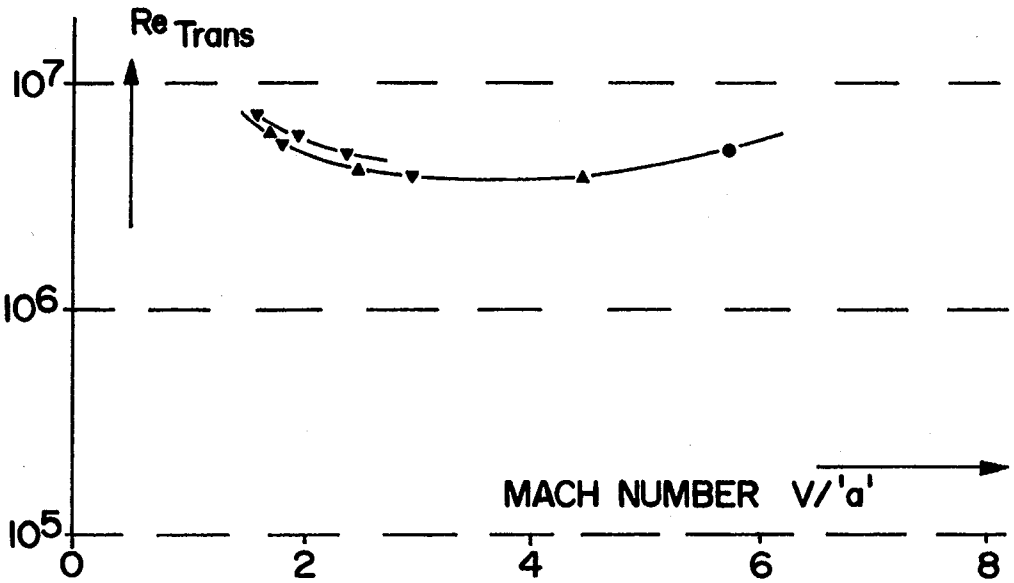
FIG. 5—is a diagram presenting the critical Reynolds number as a function of Mach number where natural transition from laminar to turbulent boundary occurs on the cylindrical body of the subcaliber projectile.
Figure 6:
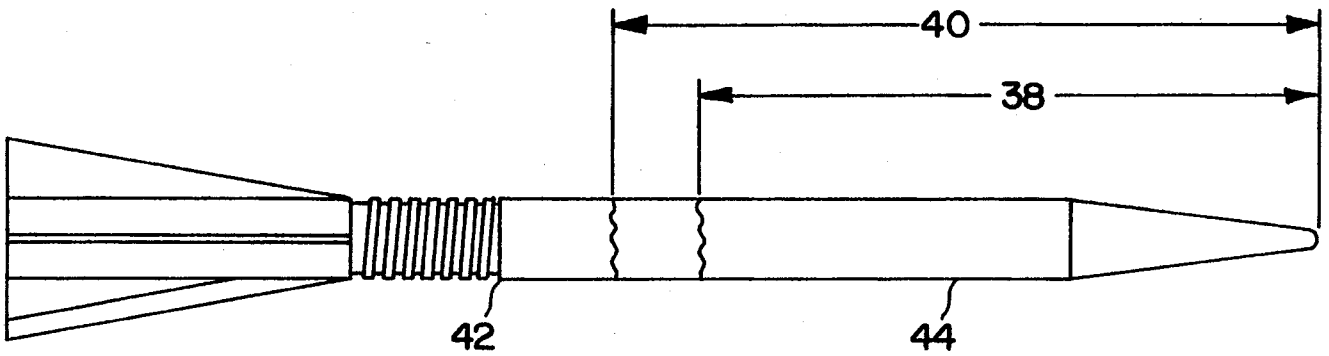
FIG. 6—is a longitudinal view of a fin stabilized subcaliber projectile illustrating the transition point between laminar and turbulent boundary layer conditions.

The Reynolds number indicating natural transition is a function of Mach number as shown for cone-cylinder bodies in FIG. 5. From this dam, the distance $L_{trans}$ can be calculated (as measured from the tip of the projectile) where boundary layer transition will occur. As an example, for a fin stabilized projectile having a length of approximately 140 mm and a launch velocity of 1400 m/s, the natural boundary layer transition will be initiated at approximately 60 mm from the projectile tip. This is illustrated in FIG. 6 showing a subcaliber fin stabilized projectile. The Figure contains the estimated points of transition initiation at launch velocity 38 and at a range of 2000 meters 40. This implies that over the forward portion of the projectile the boundary layer is laminar and beyond the point of transition will turn turbulent. It is common knowledge that the skin friction coefficient of laminar boundary layer is considerably lower than that of a turbulent boundary layer. Thus by locating the forward 42 end of the acceleration-transmitting interface to a position aft of the point of natural boundary layer transition, i.e. 38 and 40, the full benefit of maintaining the laminar boundary layer 44 and its low skin friction coefficient is assured.

In contrast, the considerably larger acceleration-transmitting interfaces including their positioning in the middle portion of the subcaliber projectile as is common in current art designs, induce forced turbulence in the boundary layer and with it increased aerodynamic drag. In addition, tripping the boundary layer ahead of its natural transition location results in rapid thickening of the boundary layer and frequently boundary layer separation.

In summary, embodiments of this invention, such as the shortening of the acceleration-transmitting interface to a minimum, whether consisting of annular grooves or a thread, combined with its location aft of the initiation of natural boundary layer transition are effective in reducing the aerodynamic drag and the resulting velocity decay during flight of a fin stabilized projectile along it trajectory to the target. This applies to projectiles regardless of whether they are launched at full or partial spin.

As an example, a subcaliber fin stabilized projectile as shown in FIG. 1, launched from a 25 mm cannon at 1400 m/s, has a measured velocity decay of 244 m/s over a range of 2000 meters. A similar projectile representative of the current state of the art has a velocity decay of 300 m/s over the same range. This is a significant difference for the effectiveness of a kinetic energy armor piercing projectile. The improvement is the result of reducing the velocity decay as a function of range and not through an increase of muzzle velocity.

What is claimed is:

1. A subcaliber fin stabilized armor piercing projectile fabricated of a high density, high strength alloy, having a large length to diameter ratio, and having a discarding sabot including a base having an inside force transmitting interface for launching from the barrel of a cannon;

said projectile comprising a slender nose, a cylindrical mid-portion, a fin assembly attached on the rear and a force transmitting interface provided on the cylindrical portion of the projectile and engaging the mating force transmitting interface provided on the inside of the base of the discarding sabot as needed to transmit the axial acceleration from the sabot to the subcaliber projectile during launch from the cannon, said projectile force transmitting interface occupying the minimum space on the projectile as determined by the magnitude of the longitudinal acceleration and the dynamic strength properties of the mating sabot base, said entire projectile force transmitting interface being located on the cylindrical portion of the subcaliber projectile aft of the point of natural transition from laminar to turbulent boundary layer, and said location assuring the maximum advantage of the low friction coefficient of laminar boundary layer.

2. The subcaliber fin stabilized projectile of claim 1 in which the projectile force transmitting interface includes a minimum number of annular grooves as needed to transfer the axial acceleration from the sabot base to the cylindrical portion of the subcaliber projectile, said entire multitude of annular grooves being located on the cylindrical portion of the projectile adjacent to the fin assembly to delay the force transition of the boundary laminar layer to turbulent boundary layer in order to take optimum advantage of the low friction coefficient of laminar boundary layer.

3. The subcaliber fin stabilized projectile of claim 2 wherein said projectile force transmitting interface has a profile of a 60 deg. stub thread configuration.

4. The subcaliber projectile of claim 1 in which the projectile force transmitting interface is a section of threads on the cylindrical portion of the projectile as needed to transmit the longitudinal acceleration from the discarding sabot to the projectile during launch in the cannon, the sabot base is aluminum, said section of threads being of minimum length as determined by the accelerating force and the dynamic strength of the aluminum sabot base, said threads having the highest pitch permissible under the dynamic strength properties of the aluminum sabot base in order to minimize the number of threads and the length of the threads over which they are distributed, said threads being modified 60 deg. stub configuration to reduce aerodynamic interference in the form of pressure and wave drag, said threaded section being located on the cylindrical portion of the subcaliber projectile entirely aft of the point of natural transition from laminar to turbulent boundary layer to take optimum advantage of the low friction coefficient of the laminar boundary layer.

5. A subcaliber fin stabilized projectile of claim 1 wherein said projectile force transmitting interface is located on the cylindrical mid-portion of the projectile and is in the form of a multitude of annular grooves to reduce the total aerodynamic drag of the projectile and to reduce its velocity decay experienced during flight to the target.

6. A subcaliber fin stabilized projectile of claim 1 wherein said projectile force transmitting interface is located on the cylindrical mid-portion of the projectile and is in the form of a multitude of annular grooves of configuration and location as to reduce the pressure and drag wave and take maximum advantage of the low friction cooefficient laminar boundary layer in order to reduce the total aerodynamic drag of the projectile and to reduce its velocity decay experienced during flight to the target.

7. A fin stabilized discarding sabot projectile as defined in claim 1 in which the projectile force transmitting interface comprises a stub acme thread configuration to minimize pressure and wave drag.

8. The subcaliber projectile of claim 1 in which the alloy is sintered tungsten alloy.

9. The subcaliber projectile of claim 1 in which the alloy is depleted uranium alloy.

10. A fin stabilized discarding sabot projectile comprising:

a subcaliber projectile having a cylindrical columnar main body with a conical nose configuration at the front of the body and a fin assembly for aerodynamic stabilization at the rear of the body, a discarding sabot fitted to the projectile for centering and radially supporting the subcaliber projectile in a gun barrel, and for transmitting longitudinal acceleration to the subcaliber projectile during launch from a gun barrel.

the subcaliber projectile having an acceleration transfer interface and the discarding sabot having an equivalent section mating with the acceleration transfer interface for transfer of longitudinal acceleration from sabot to subcaliber projectile, and the entire acceleration transfer interface being located on the subcaliber main body aft of the point of natural boundary layer transition from laminar to turbulent occurring during flight of the subcaliber projectile.

11. A fin stabilized discarding sabot projectile as defined in claim 10 in which the point of natural boundary layer transition is determined from:

$$Re_{Trans} = \frac{V \times L_{Trans}}{v}$$

where:

V Projectile velocity (m/s)

$L_{Trans}$=distance from the projectile nose to where natural transition occurs (m)

v=kinematic viscosity of air ($m^2/s$) $Re_{Trans}$=Reynolds number.

12. A fin stabilized discarding sabot projectile as defined in claim 10 in which the acceleration transfer interface is confined to length not more than 1.5 body diameters.

13. A fin stabilized discarding sabot projectile as defined in claim 10 in which the acceleration transfer interface consists of a series of annular grooves each having a groove profile defined by a load flank angle of approximately 30 degrees measured from normal to the axis, and a release flank angle of at least 30 degrees measured from normal to the axis.

14. A fin stabilized discarding sabot projectile as defined in claim 13 in which the annular grooves are no deeper than 0.065 subcaliber projectile diameters.

15. A fin stabilized discarding sabot projectile as defined in claim 10 in which the acceleration transfer interface has truncated grooves of predetermined groove spacing along the interface and with a crest width and depth of grooves approximately 0.3 of groove spacing.

16. A fin stabbed discarding sabot projectile as defined in claim 10 in which the acceleration transfer interface consists of a series of annular grooves each having a groove profile defined by a load flank angle of approximately 30 degrees measured from normal to the axis, a release flank angle of at least 30 degrees measured from normal to the axis, and predetermined groove spacing along the interface and with a crest width and depth of grooves approximately 0.3 of groove spacing.

17. A fin stabilized discarding projectile as defined in claim 10 in which the acceleration transfer interface has a profile of a modified 60 degree stub thread configuration to minimize pressure and wave drag.

18. The projectile of claim 10 in which the subcaliber projectile is sintered tungsten alloy.

19. The projectile of claim 10 in which the subcaliber projectile is depleted uranium alloy.

* * * * *